US005535954A

United States Patent [19]

Hudson et al.

[11] Patent Number: 5,535,954

[45] Date of Patent: Jul. 16, 1996

[54] METERED LAMINA AIR INTAKE FOR A HAMMERMILL FEEDER

[75] Inventors: James O. Hudson, Cary, N.C.; Heath L. Hartwig, Waterloo, Iowa

[73] Assignee: Roskamp Champion, Waterloo, Iowa

[21] Appl. No.: 184,123

[22] Filed: Jan. 21, 1994

[51] Int. Cl.[6] ..... B02C 13/286; B02C 23/02; B02C 23/18

[52] U.S. Cl. ..... 241/186.2; 241/186.4

[58] Field of Search ..... 241/55, 56, 57, 241/58, 62, 186.2, 186.3, 186.4; 222/3, 4, 135, 631, 526

[56] References Cited

U.S. PATENT DOCUMENTS

| | | | |
|---|---|---|---|
| 1,702,248 | 2/1929 | Crites | 241/186.2 X |
| 1,760,245 | 5/1930 | Lykken | 241/186.2 X |
| 2,070,508 | 2/1937 | Cecka | 241/186.2 X |
| 2,764,361 | 9/1956 | Moore | 241/186.2 X |
| 2,941,731 | 6/1960 | Lykken et al. | 241/186.2 X |
| 2,953,307 | 9/1960 | Lykken et al. | 241/186.2 X |

FOREIGN PATENT DOCUMENTS

| | | | |
|---|---|---|---|
| 3436796 | 4/1986 | Germany | 241/186.2 |

*Primary Examiner*—Timothy V. Eley
*Attorney, Agent, or Firm*—Walter C. Vliet; Michael H. Minns

[57] ABSTRACT

A feeder for comminuting equipment which combines inlet air and feed in lamina flow to minimize turbulent mixing by minimizing the air and feed convergence angles within the feeder.

7 Claims, 3 Drawing Sheets

METERED LAMINA AIR INTAKE FOR A HAMMERMILL FEEDER

BACKGROUND OF THE INVENTION

This invention relates generally to hammermills and other comminuting devices to size grains for different end products, and more particularly to a product feeder for delivering feed product and the like to a hammermill along with a metered quantity of air. Many types of feeders have evolved for product handling, including rotary pocket feeders, vibratory pan feeders, air syphon feeders, and gravity feeders, to name a few.

All agricultural hammermills utilize air to increase their grinding efficiency. The air may be needed to convey away ground product or to keep the screens clear during grinding.

In the prior art feeders, the air has been introduced to the grinding chamber near the hammermill inlet. This abrupt introduction of turbulent air causes poor product flow, and decreases throughput. The ability to introduce air into the feed stream in a nonturbulent manner results in smooth lamina product flow, and increases hammermill grinding efficiency. Conversely, abrupt air introduction can result in turbulent flow, and in some cases, even backflow of product through the air inlet.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a feeder for comminuting equipment comprising an elongate container of generally trapezoidal end cross-section having a top width greater than its bottom; the container being further provided with an air inlet into the container along a portion of its top in the generally elongate direction and a feed inlet into the container in its top generally parallel to the air inlet and a feed and air outlet from the container on its bottom; and wherein feed and air are introduced into the container in generally downward parallel lamina flow in a progressively converging direction to simultaneously exit the feed and air outlet.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
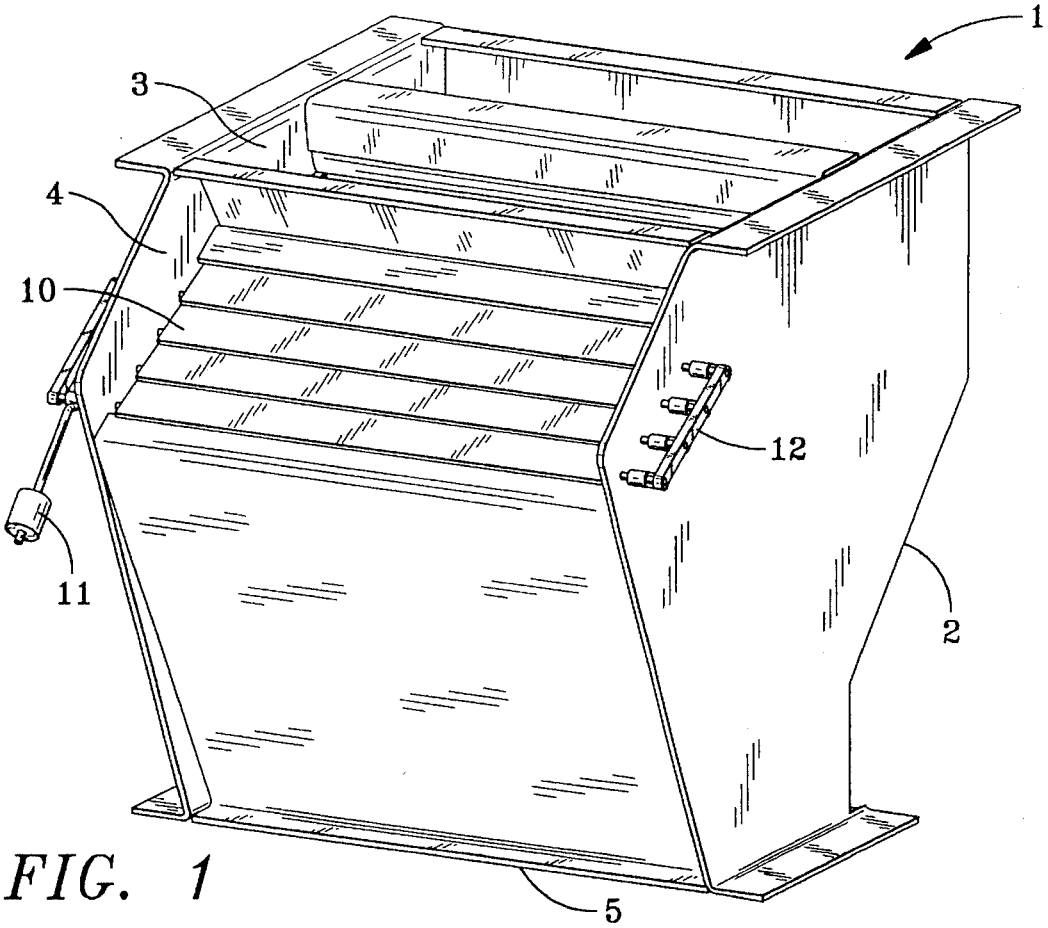
FIG. 1 is a perspective view of a feeder according to the present invention.
Figure 2:
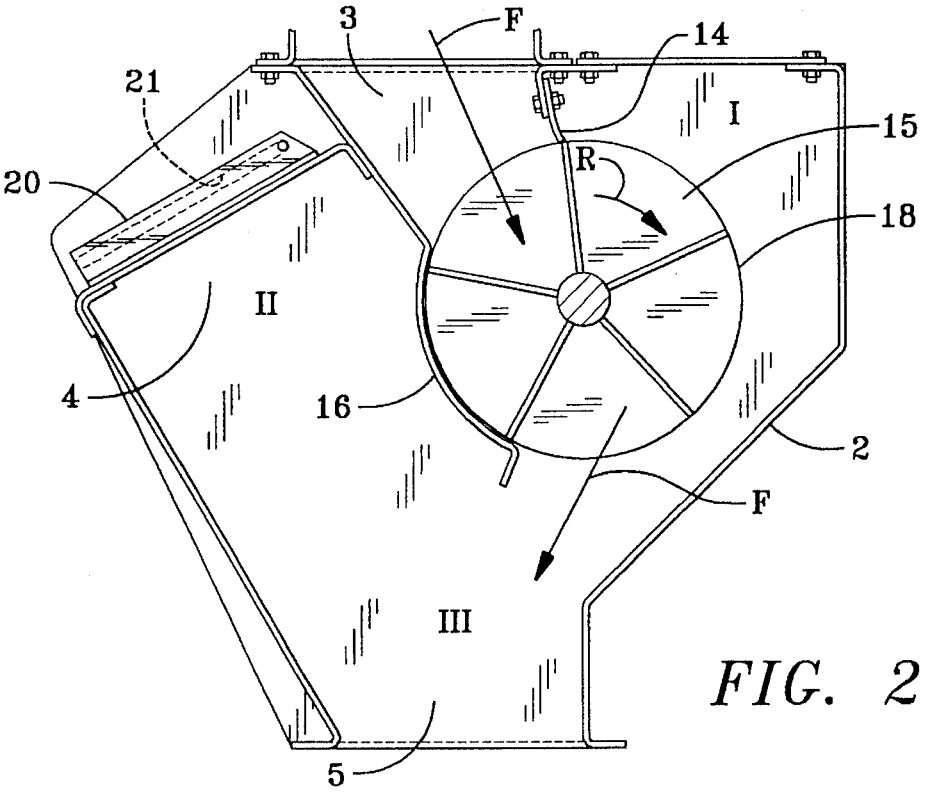
FIG. 2 is a cross section of one embodiment of the present invention incorporating a rotary pocket feeder and a manual air gate in the closed position.

Referring to FIG. 1, a hammermill feeder 1, according to the present invention, is shown in the form of a container or enclosure 2, preferably constructed of typical sheet metal construction of generally elongated trapezoidal form, having a modified V/Y end configuration, best seen in FIG. 2. The feeder has a feed inlet area 3 in the top, an air inlet 4, generally in the left hand V leg, and a feed and air outlet 5 on the bottom. Air entering the feeder is regulated by means of an automatic air shutter 10, as shown in FIG. 1, or a manual air slide regulator 20 and slide guide 21 as shown in the FIG. 2 embodiment.

Figure 6:
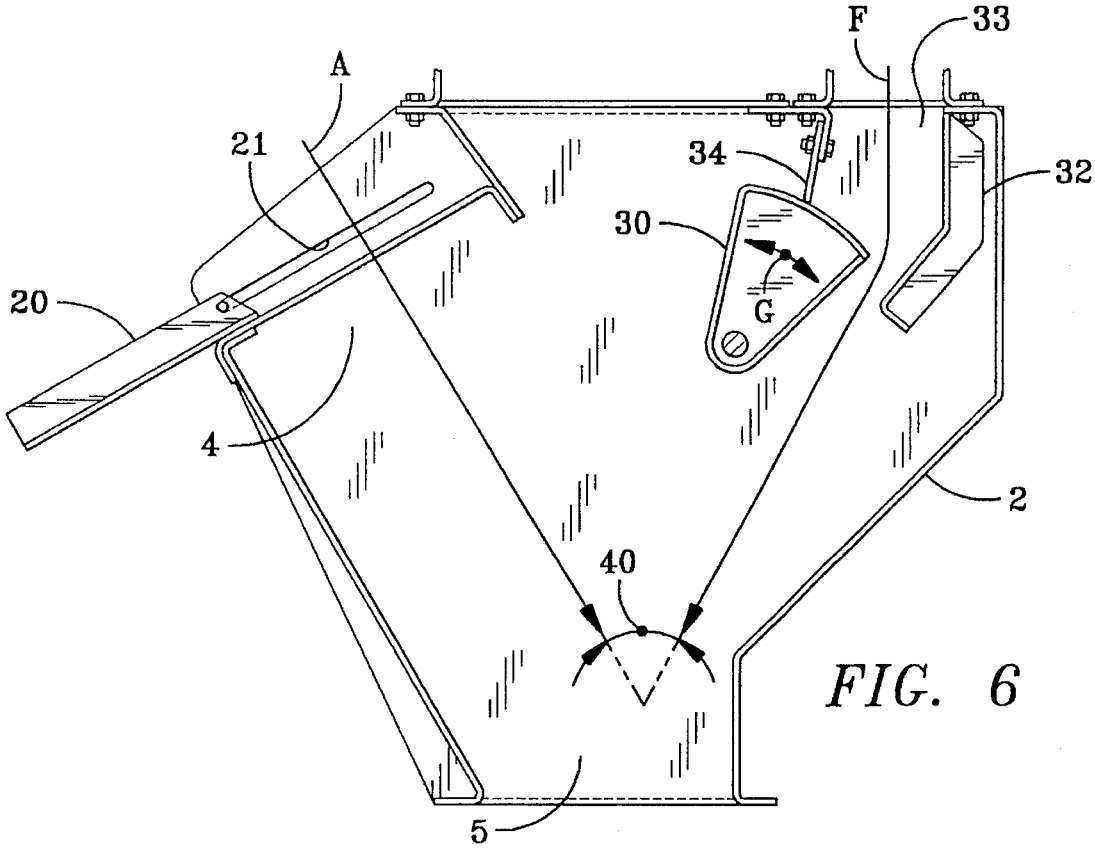
FIG. 6 is a second alternate embodiment of the feeder according to the present invention incorporating a gravity feeder controlled by a feed gate.

Inlet product feed is regulated by means of a rotary pocket feeder 15, in the FIG. 2 embodiment, and by means of a variable gravity feed gate 30, in the FIG. 6 embodiment. In the FIG. 6 embodiment, feed rate of feed entering alternate feed inlet 33 is controlled by the rotary position G of the feed gate 30. Seal 34 prevents gate bypass. Feed flow guide 32 help direct the incoming feed to minimize the convergence angle 40. In all cases, feed F is introduced generally into the right hand or Y leg of the feeder through the metering device, i.e., rotary pocket 15 or gate 30.

Air A, introduced in the feeder by suction or vacuum created by the downstream process, enters through the manual control gate 20, or automatic air shutter 12, and proceeds generally downward in a converging direction with the feed to the feed and air outlet. Minimum convergence angles 40 between air and feed are desirable. It is felt that useful results are obtained in the range of 30 to 60 degrees. Since both feed and air are introduced along the length of the feeder and proceed both generally downward and at a minimum convergence angle 40 (see FIG. 3), the mixing of air and feed within the feeder is generally lamina in nature and gentle compared to mixing in the prior art. In the prior art, mixing of air and feed occurred generally at right angles creating unwanted swirls of feed. The lamina flow of the present invention improves the performance of the hammermill.

Air entering the feeder is regulated by means of a manual slide gate. In the alternate embodiment of FIGS. 1, 4, and 5, air is supplied on demand (suction) through automatic air gate shutters 10, as regulated by means of adjustable shutter weight 11, in a manner well known for such shutters. The shutters are coordinated in their rotation by the shutter control mechanism 12, which in turn is acted upon by the control weight 11.

The rotary pocket feeder for the feed inlet, as best seen in FIGS. 2–5, comprises a rotating segmented cylinder which is supported at each end and may be driven by a convenient rotary drive, not shown, in a controlled rotation rate to effect the desired degree of feed entry to the feeder.

The drum 18 rotates clockwise as indicated by the rotation arrow R. A wiping seal 14 controls the amount of feed in each pocket and a bypass seal 16 prevents feed from bypassing the rotary drum. The bypass seal 16 divides the feeder into three chambers, a feed chamber I, an air chamber II, and a combined feed and air chamber III.

Figure 3:
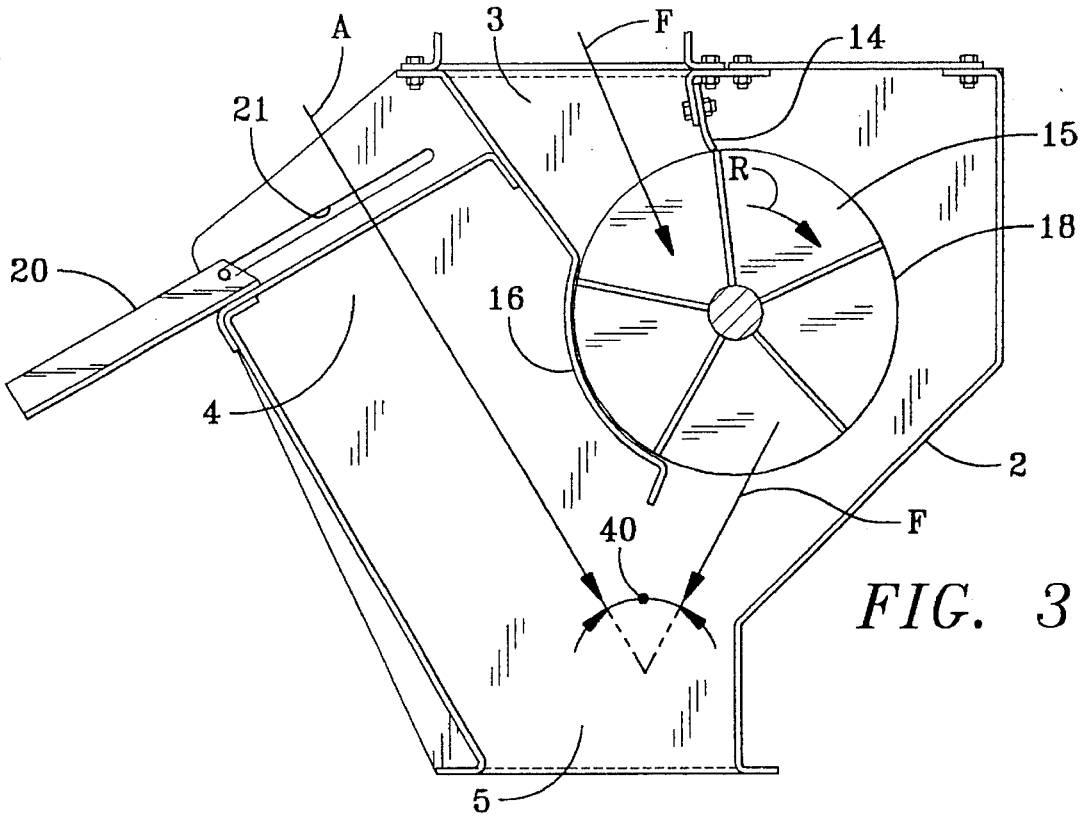
FIG. 3 is a cross section, as shown in FIG. 2, with the manual air gate in the open position.
Figure 4:
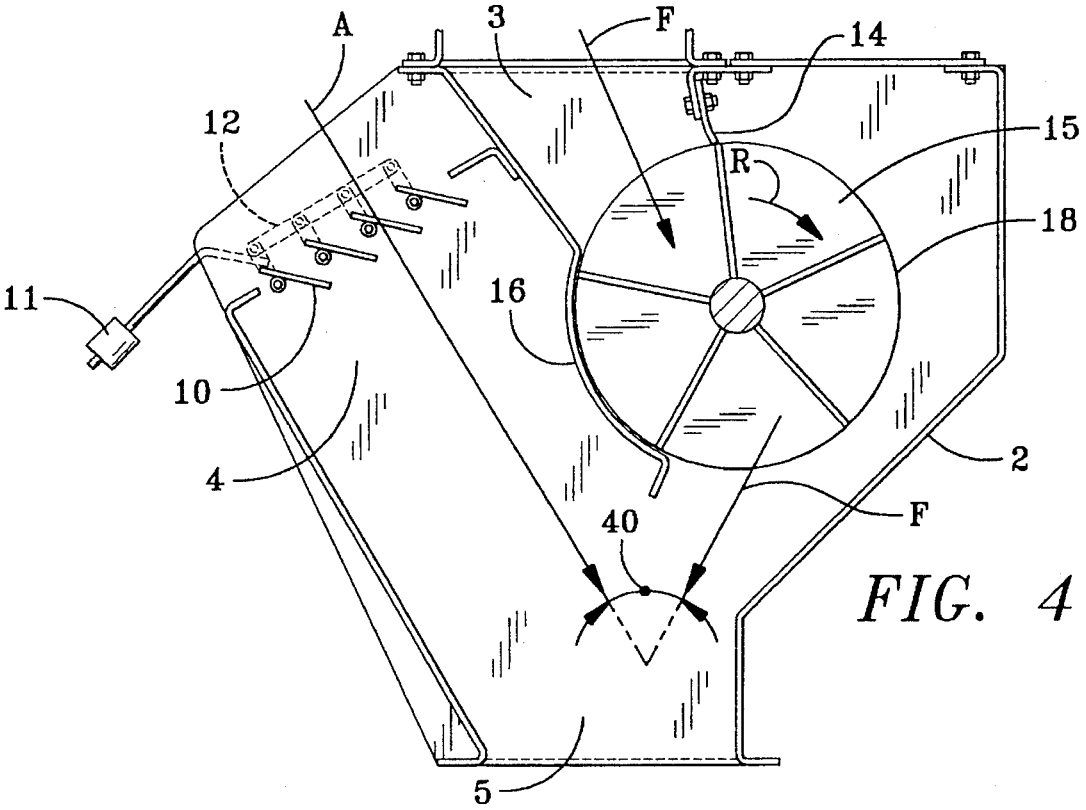
FIG. 4 is a cross section of an alternate embodiment of the present invention having a rotary pocket feeder and an automatic shutter air gate in the open position.
Figure 5:
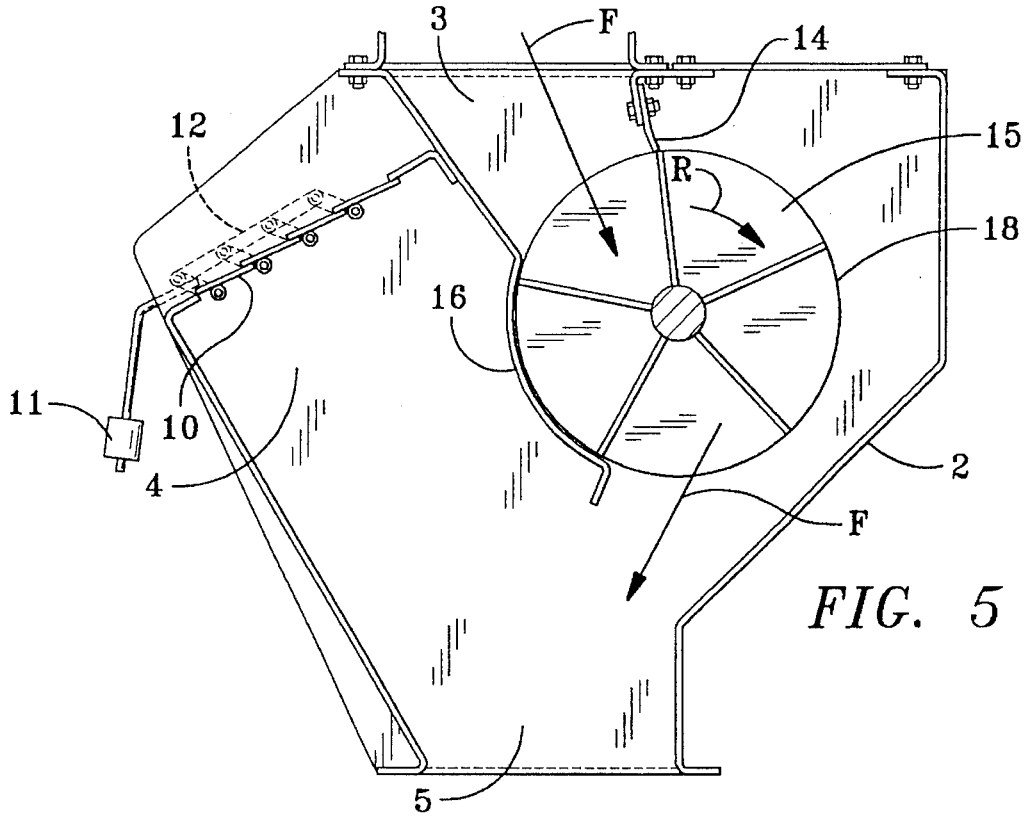
FIG. 5 is a feeder according to FIG. 4 showing the automatic air gate in the closed position.

According to the present invention, the feeder air inlet has been designed to allow air to flow unobstructed through the feeder and to combine with the product before it enters the grinding chambers of the hammermill. For fixed air systems, a manual adjustable air gate may be furnished to meter the air as shown in FIGS. 2, 3 and 6 to meter the air. A shutter type metering device, as shown in FIGS. 1, 4, and 5, may be used on mills where air requirements vary. As previously stated, the amount of air that enters the feeder is regulated by the suction or vacuum created by the hammermill which acts against the shuttered louver and adjustable center weight. The ability of the present invention to introduce air into the feed stream in a nonturbulent manner results in smooth lamina product flow and increases hammermill grinding efficiency.

What is claimed is:

1. A feeder for comminuting equipment comprising:

a housing of generally trapezoidal end cross-section having a top width greater than a bottom width of the housing, the housing having an air inlet along a portion of the housing top in a generally elongate direction, the housing having a feed inlet generally parallel to the air inlet, the housing having a combined feed and air outlet in its bottom;

a feed means for controlling the rate feed enters the housing;

an air means for introducing air into the feed in generally downward parallel lamina flow, the air means introducing the air into the feed only after the feed exits the feed means; and a baffle means for preventing the air means from introducing the air into the feed before the feed exits the feed means, the baffle means dividing the housing into an air chamber, a feed chamber and a combined feed and air chamber, the feed means being located within the feed chamber.

2. The feeder according to claim 1, wherein the air enters the combined feed and air chamber in a first direction, the feed enters the combined feed and air chamber in a second direction, the first direction being at an angle of between 10 and 80 degrees to the second direction.

3. The feeder according to claim 1, wherein the air enters the combined feed and air chamber in a first direction, the feed enters the combined feed and air chamber in a second direction, the first direction being at an angle of between 30 and 60 degrees to the second direction.

4. The feeder according to claim 1, wherein the air enters the combined feed and air chamber in a first direction, the feed enters the combined feed and air chamber in a second direction, the first direction being at an angle of approximately 45 degrees to the second direction.

5. The feeder according to claim 1, wherein the feed means is a rotary drum feeder.

6. The feeder according to claim 1, wherein the feed means is gravity feeder, the gravity feeder including a feed gate.

7. A feeder for comminuting equipment comprising:

a housing of generally trapezoidal end cross-section having a top width greater than a bottom width of the housing, the housing having an air inlet along a portion of the housing top in a generally elongate direction, the housing having a feed inlet generally parallel to the air inlet, the housing having a combined feed and air outlet in its bottom, the housing being divided into an air chamber, a feed chamber and a combined feed and air chamber;

a feed means for controlling the rate feed enters the housing, the feed means being located within the feed chamber, the feed exiting the feed means into the combined feed and air chamber, the feed entering the combined feed and air chamber in a first direction;

an air means for introducing air into the feed in generally downward parallel lamina flow, the air means introducing the air into the feed in the combined air and feed chamber only after the feed exits the feed means, the air entering the combined feed and air chamber in a second direction, the first direction being at an angle of between 10 and 80 degrees to the second direction; and a baffle means for preventing the air means from introducing the air into the feed before the feed exits the feed means.

* * * * *